US006354717B1

(12) United States Patent
Wang

(10) Patent No.: US 6,354,717 B1
(45) Date of Patent: Mar. 12, 2002

(54) LUMINAIRE WITH REFLECTOR SHIELD

(75) Inventor: James P. Wang, Christiansburg, VA (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 09/679,624

(22) Filed: Oct. 5, 2000

(51) Int. Cl.[7] ..... F21V 7/05

(52) U.S. Cl. ..... 362/297; 362/296; 362/346; 362/278

(58) Field of Search ..... 362/296, 297, 362/298, 346, 347, 257, 278, 320

(56) References Cited

U.S. PATENT DOCUMENTS 1,424,525 A 8/1922 Seely
3,997,778 A 12/1976 Fieldstad, Jr. et al.
4,028,542 A 6/1977 McReynolds et al.
4,338,655 A 7/1982 Gulliksen et al.
4,519,018 A 5/1985 Rowland
4,954,938 A * 9/1990 Lyons ..... 362/298
5,003,447 A 3/1991 James et al.
5,274,533 A 12/1993 Neary et al.
6,168,295 B1 * 1/2001 Hein ..... 362/308

* cited by examiner

*Primary Examiner*—Sandra O'Shea
*Assistant Examiner*—Margobind S. Sawhney
(74) *Attorney, Agent, or Firm*—Mark S. Bicks; Marcus R. Mickney; Alfred N. Goodman

(57) ABSTRACT

A light shielding and reflecting device is connected to a luminaire reflector that is quickly and easily adjustable to alter the emitted beam configuration. The luminaire includes a housing, a lamp with optical sides mounted in the housing, a main reflector mounted in the housing about the lamp, and a removable reflector shield having a plurality of tabs releasably engaging openings in the main reflector. The shield is positioned to block light from emitting into an undesired area and redirects that light to a desired area. A second shield can be used depending on the desired beam configuration.

20 Claims, 4 Drawing Sheets

LUMINAIRE WITH REFLECTOR SHIELD

CROSS-REFERENCE TO RELATED APPLICATION

This application is related to U.S. patent application Ser. No. 09/502,794 to Wang, entitled "Adjustable Reflector Assembly for Luminaire" and filed Feb. 11, 2000, the subject matter of which is hereby incorporated by reference.

FIELD OF THE INVENTION

The present invention relates to a luminaire having a removable reflector shield. More particularly, the present invention relates to a luminaire having a main reflector and one or two reflector shields releasably attached to the main reflector. Each reflector shield has tabs for releasably engaging openings in a plurality of slots in the main reflector. The reflector shields may be used individually or together to create a variety of beam configurations. The reflector shields can be easily disengaged and reattached to create new beam configurations.

BACKGROUND OF THE INVENTION

Luminaires can be mounted in a variety of locations, and are often mounted in or near corners in a room. Light is wasted when it is emitted directly into the walls forming the corner. Luminaires are also often installed to provide lighting on the owner's property. Light is again wasted when it is emitted directly onto neighboring property rather than onto the intended property of the owner. Moreover, lighting of the neighboring property may be unwanted and considered a nuisance.

Luminaires with adjustable reflectors and/or shields are common to the lighting industry. Typically, those adjustable reflectors require a lot of time to install due to the numerous parts making up the reflector, as well as requiring tools to perform the installation. To change the emitted beam configuration of the luminaire, the adjustable reflectors must be disconnected and then reconnected in a new position within the luminaire. Disconnecting and then reconnecting those reflectors requires tools and is therefore a labor intensive and time consuming task. Additionally, those reflectors are costly to manufacture due to the various parts making up the adjustable reflectors. Furthermore, a large inventory is required since the reflectors are made up of several different parts.

Examples of existing light reflectors are disclosed in the following references: U.S. Pat. No. 4,338,655 to Gulliksen et al.; U.S. Pat. No. 4,519,018 to Rowland; and U.S. Pat. No. 5,274,533 to Neary et al.

Thus, improved reflector shields are needed to make adjustment of the luminaire to its specific location and to the desired lighting simpler and more efficient.

SUMMARY OF THE INVENTION

Accordingly, an object of the present invention is to provide a luminaire with a reflector and/or shield that blocks light from emitting into an unwanted area, reflects that light to a desired area, and is simple and inexpensive to manufacture and simple and quick to adjust.

Another object of the present invention is to provide a reflector shield that can be attached to an existing luminaire.

A further object of the present invention is to provide a reflector shield that quickly and easily disconnects and reattaches to a luminaire for altering its emitted beam configuration, without requiring tools for such disconnection and reattachment.

The foregoing objects are basically attained by a luminaire having a housing, a lamp with optical sides mounted in the housing, and a main reflector mounted in the housing about the lamp. The main reflector has a plurality of openings. A first removable reflector shield has a body portion and a plurality of tabs extending from the body portion and releasably engaged in the main reflector openings, thereby allowing the reflector shield to be attached to an existing luminaire. Moreover, the configuration of the reflector shield makes it simple and inexpensive to manufacture.

The foregoing objects are also attained by a method of blocking and redirecting light from a luminaire by bending a first reflector shield to a shape defined by a plurality of openings in a luminaire reflector mounted in a luminaire. The first shield is releasably attached to the luminaire reflector by inserting a plurality of tabs on the first shield in the plurality of openings in the luminaire reflector for blocking and redirecting light emitted by a lamp mounted in the luminaire, thereby providing a luminaire with a reflector shield that blocks and redirects light as desired. The lamp has optical sides. The first shield covers a significant portion, preferably at least half, of the optical sides of the lamp. A first beam configuration is created by attaching the first shield on the luminaire reflector in a position resulting in the first beam configuration.

The luminaire with a reflector shield of the present invention blocks light from emitting into an unwanted area and reflects that light to a desired area. Furthermore, the beam configuration may be altered quickly and easily by disconnecting and reattaching the reflector shield in a new position, without requiring tools to perform the task. For example, a single shield may be used when the luminaire is mounted along a wall and the light is to be directed away from the wall. Two shields may be used when a 360-degree cut-off or spot-light effect is desired. Additionally, two shields may be overlapped to create a 270-degree cut-off, such as for use in a corner, thereby directing light away from the corner and into the remaining open quadrant. Due to the ease with which the shields may be installed in and removed from an existing luminaire, the arrangement of the shields may be readily altered to create a new beam configuration.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

Referring now to the drawings that form a part of the original disclosure.

DETAILED DESCRIPTION OF THE INVENTION

Figure 1:
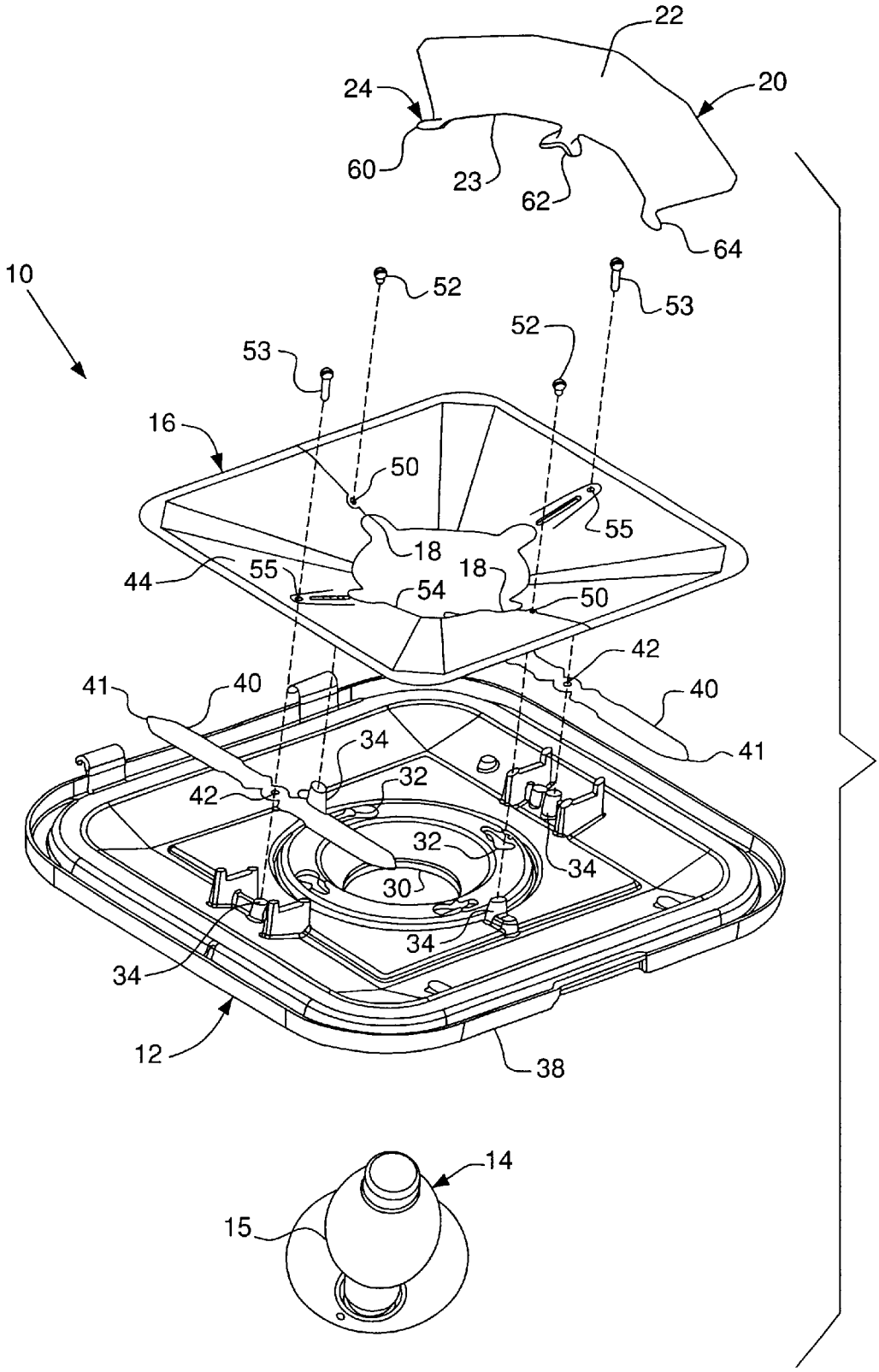
FIG. 1 is an exploded, perspective view of a luminaire according to a first embodiment of the present invention, including a reflector shield, a main reflector, a luminaire housing, and a lamp.
Figure 2:
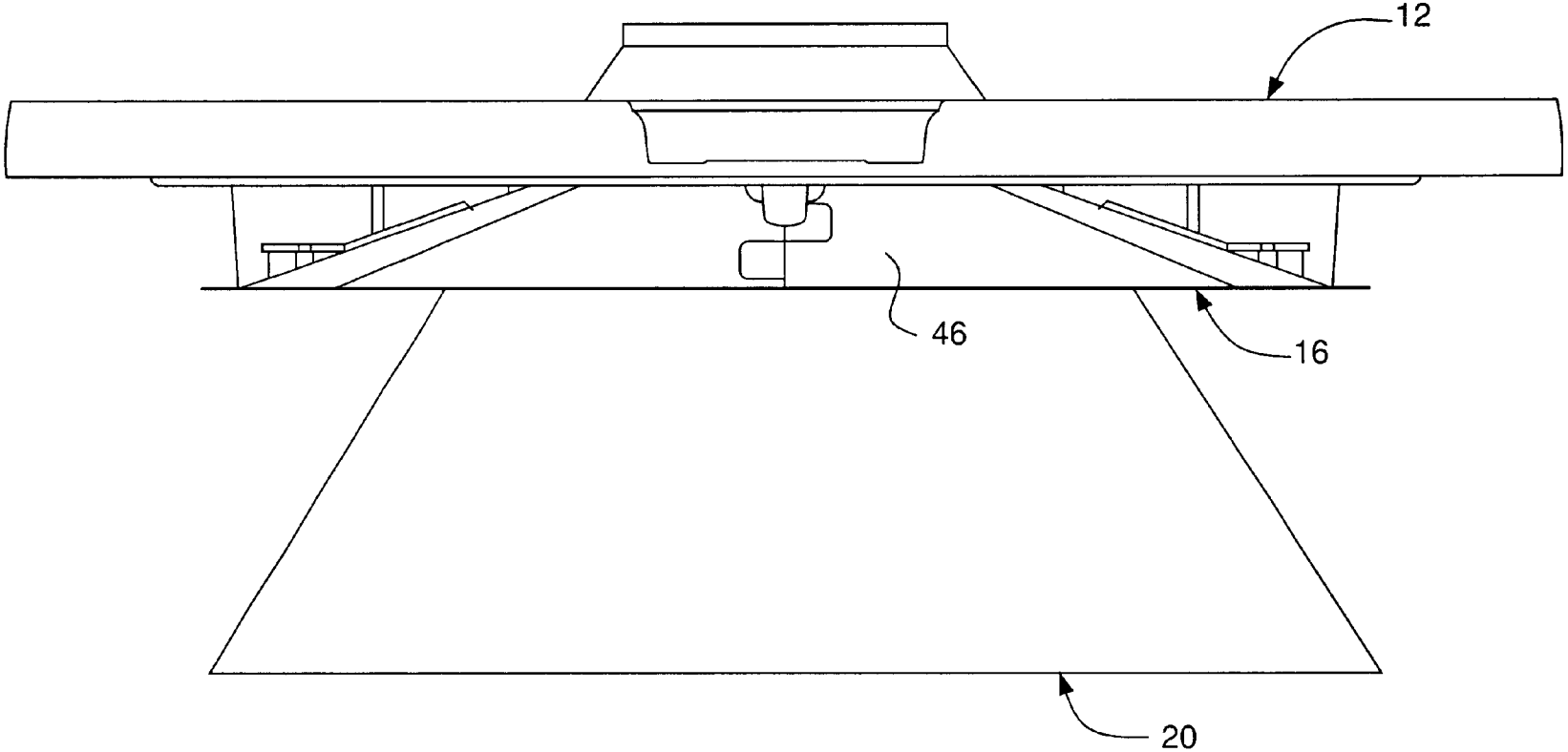
FIG. 2 is a side elevational view of the luminaire of FIG. 1, with the reflector shield inserted in the main reflector, and the main reflector inserted in the luminaire housing.
Figure 6:
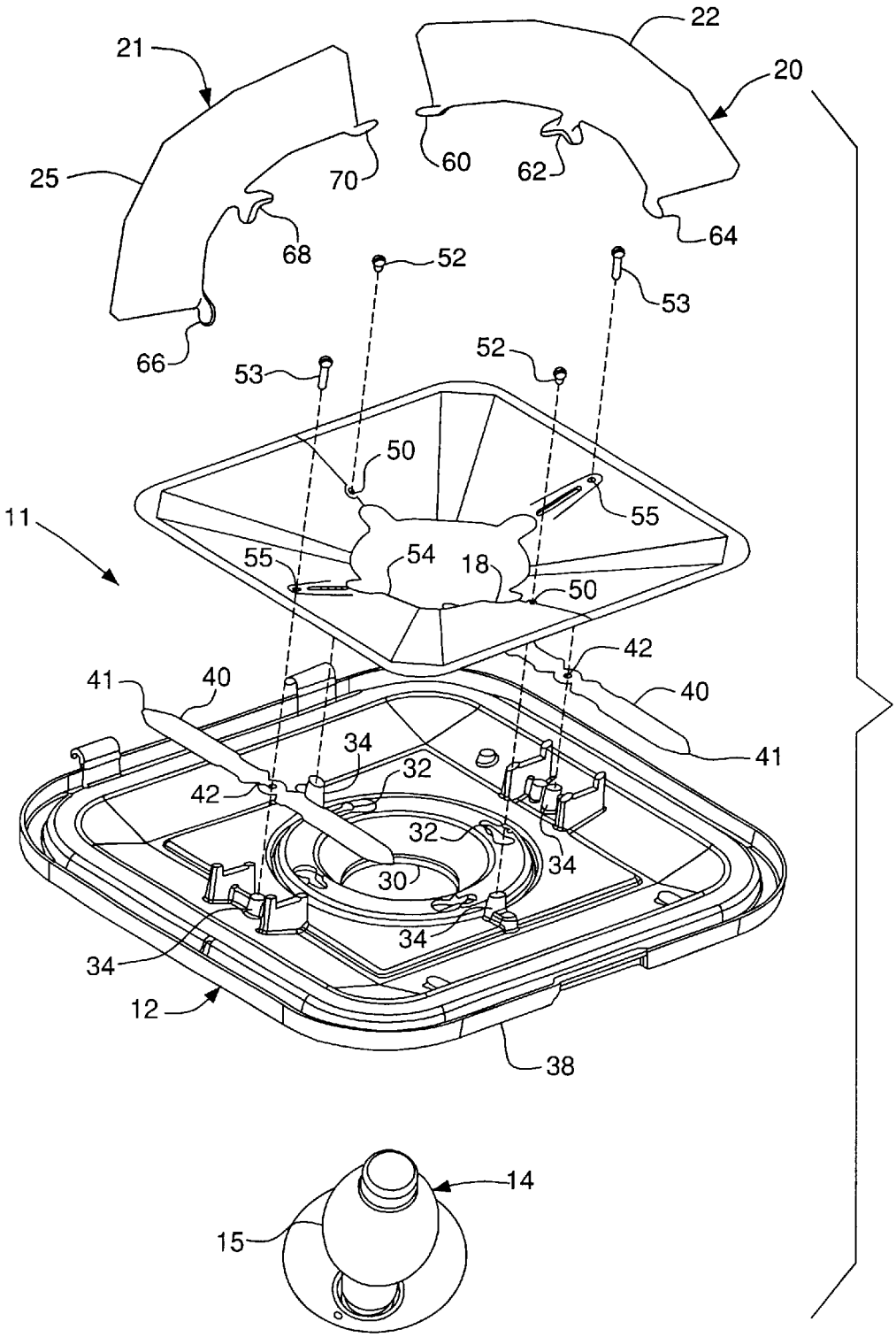
FIG. 6 is an exploded, perspective view of a luminaire according to a second embodiment of the present invention, including two reflector shields, a main reflector, a luminaire housing, and a lamp.

As seen in FIG. 1, the luminaire 10 in accordance with the first embodiment of the present invention comprises a housing 12, a lamp 14 with optical sides 15 mounted in the housing, a main reflector 16 having a plurality of openings 18 mounted in the housing about the lamp, and a first removable reflector shield 20. Reflector shield 20 has a body portion 22 and a plurality of tabs 24 extending from the body portion for releasably engaging the openings in the main reflector. As shown in FIG. 6, a luminaire 11 according to a second embodiment of the present invention has a second removable reflector shield 21 attached to the main reflector 16 in addition to the first removable reflector shield 20. As shown in FIG. 2, the main reflector 16 receives the reflector shield 20 for blocking light from emitting into an unwanted area and redirecting that light to a desired area.

The housing 12, as shown in FIGS. 1 and 6, has an aperture 30 for receiving the lamp 14. A plurality of mounting posts 34 on the lower side 36 of the housing 12 mount the main reflector 16 to the housing 12. A plurality of keyholes 32 in the housing 12 receive connectors on a ballast box (not shown) for mounting the ballast box to the upper surface 38 of the housing.

The main reflector 16 has mounting holes 50 and 55 that allow the main reflector to be securely mounted to the housing 12. Fasteners 52 and 53 are inserted through mounting holes 50 and 55, respectively, in the main reflector 16 and are received by the mounting posts 34 of the housing 34. An aperture 54 in the main reflector 16 allows the lamp 14 to be inserted through the reflector once the main reflector has been mounted to the housing 12. A plurality of openings 18 in the main reflector are adapted to receive the plurality of tabs 24 on the reflector shield 20. Preferably, the plurality of openings 18 are substantially semi-circular and are equally spaced along or about the aperture 54. Preferably, the main reflector 16 has four openings 72, 74, 76 and 78 for receiving the plurality of tabs 24. The plurality of openings 18 in the main reflector 16 may receive only a single reflector shield 20 (FIG. 1) or first and second reflector shields 20 and 21 (FIG. 6). The main reflector is more fully described in U.S. patent application Ser. No.09/502,794, which is incorporated by reference above.

Deployment bars 40 are positioned between the main reflector 16 and the housing 12. A fastener hole 42 in the deployment bar 40 receives fastener 53 for securing the deployment bar between the main reflector 16 and the housing 12. By further threading fastener 53 in mounting post 34, bar ends 41 of the deployment bar are raised, thereby lowering that portion of the main reflector 16. The fastener may be threaded enough to secure the main reflector and retain the deployment bar 40 in a substantially horizontal position (the normal position). Then, by further threading the fastener 53 into the mounting post, the configuration of the main reflector 16 may be adjusted from the normal position to a down position, which occurs when the fastener is fully received by the mounting post 34.

The lamp 14 is inserted first through the main reflector aperture 54 and then through the housing aperture 30. Typically, the lamp 14 is mounted in a socket connection in a ballast box (not shown), which is mounted to the upper surface 38 of the housing 12 through the plurality of keyholes 32.

Figure 5:
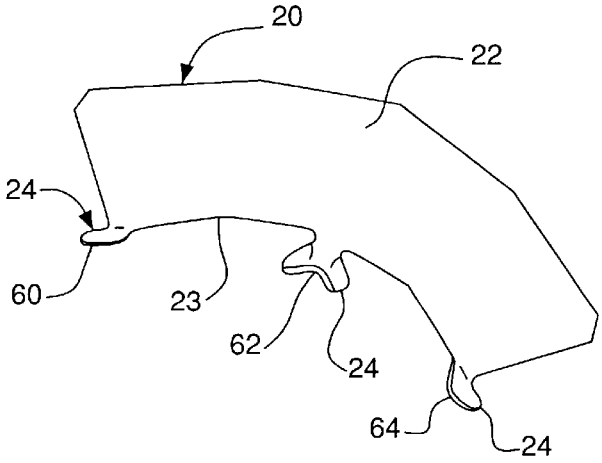
FIG. 5 is a perspective view of the reflector shield of the luminaire of FIG. 1.

The reflector shield 20, as shown in FIG. 5, has a main body portion 22 and a plurality of tabs 24 extending from the main body portion. The tabs 24 are inserted in the plurality of openings 18 in the main reflector 16 for releasably attaching the reflector shield 20 to the main reflector 16. When attached to the main reflector 16, the reflector shield 20 covers a significant portion of the optical sides 15 of the lamp. Preferably, the reflector shield 20 covers at least half of the optical sides 15 of the lamp, but the reflector shield may cover more or less depending on the lighting requirements at the given usage location. Preferably, the reflector shield has three tabs 60, 62 and 64. The first and third tabs 60 and 64 are preferably substantially "L-shaped", while the second tab 62 is preferably substantially "T-shaped". The first and third tabs 60 and 64 are located at opposing edges of a side 23 of the shield, with the second tab 62 located between the first and third tabs.

A second reflector shield 21, as shown in FIG. 6, may be used in conjunction with the first reflector shield 20 to create a wider variety of beam configurations. Preferably, the second reflector shield 21 is substantially identical to the first reflector shield 20, having a first tab 66 and a third tab 70 that are substantially "L-shaped", and a second tab 68 positioned between the first and third tabs and that is substantially "T-shaped".

Preferably, the reflector shield 20 is made of a metal or high temperature material that is springy or resilient in nature, such as specular aluminum. Preferably, the tabs 24 are formed unitarily with the reflector shield 20.

Assembly and Disassembly

As seen in FIG. 2, the luminaire 10 is completely constructed by assembling the various parts as shown in FIGS. 1 and 6. The main reflector 16 is secured to the luminaire housing 12 by fasteners 52 and 53. The fasteners 52 and 53 are inserted through the mounting holes 50 and 55, respectively, in the main reflector 16 and through the fastener holes 42 in the deployment bars, and are received by the mounting posts 34 on the inner surface 36 of the main reflector. This positions the deployment bars 40 between the main reflector 16 and the housing 12. As is more fully described in the patent application incorporated by reference, the shape of the main reflector 16 is controlled by the amount fasteners 53 are threaded into the mounting posts 34.

The lamp 14 is then inserted first through the main reflector aperture 54 and then through the housing aperture 30. Typically, the lamp 14 is received in a socket connection in a ballast box (not shown). Connectors on the ballast box are inserted in the keyholes 32 on the outer surface 38 of the housing 12, thereby positioning the lamp 14 within the luminaire 10.

Figure 3:
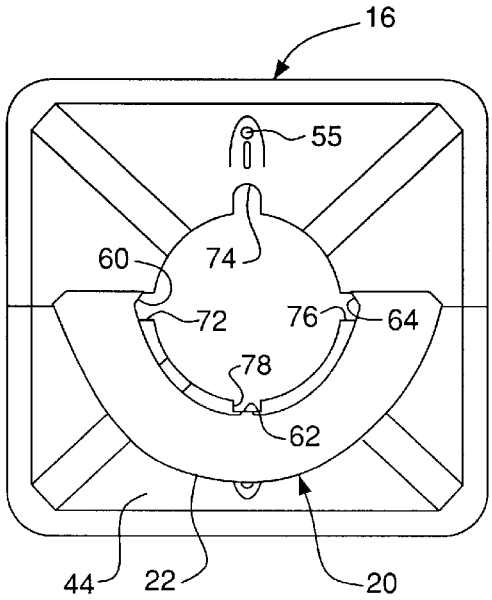
FIG. 3 is a top plan view of the luminaire of FIG. 1 showing the reflector shield inserted in the main reflector.
Figure 4:
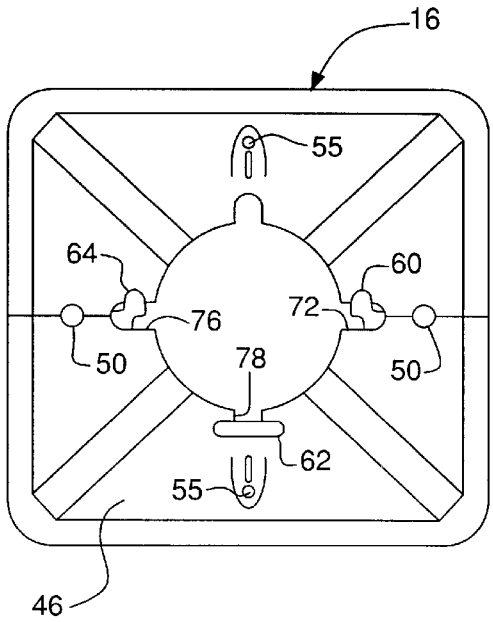
FIG. 4 is a bottom plan view of the luminaire of FIG. 1 showing the reflector shield inserted in the main reflector.

The first removable reflector shield 20 may be installed on the main reflector 16. The reflector shield 20 is bent into a shape defined by the plurality of openings 18 in the main reflector 16. Preferably, the reflector shield 20 is substantially parabolic when installed on the main reflector 16. The plurality of tabs 24 on the first reflector shield 20 are inserted in the plurality of openings 18 in the main reflector 16, as shown in FIG. 3. The plurality of tabs 24 are then hooked around the selected openings 18 to secure the reflector shield 20 to the main reflector 16 in the desired circumferential position, as shown in FIG. 4. The installed reflector shield 20 covers a significant portion, preferably at least half, of the optical sides 15 of the lamp.

A second reflector shield 21 may be added once the first reflector shield 20 has been installed. The second reflector shield with the first shield creates a 360-degree cut-off of the optical sides of the lamp. Tabs 60, 62, and 64 of the first reflector shield 20 are inserted into openings 72, 74 and 76, respectively, of the main reflector 16 to obtain the illustrated position. The tabs 66, 68 and 70 of the second reflector shield 21 can then be inserted into openings 72, 78 and 76, respectively. In this configuration, the lamp 14 is completely enclosed by the two reflector shields 20 and 21. All light emitted by the optical sides 15 of the lamp 14 is blocked (360-degree cut-off) and redirected downward, thereby creating a spotlight configuration for the luminaire 10.

If 270-degree cut-off beam configuration is desired, then the reflector shields 20 and 21 are positioned such that approximately half of the body portions 22 and 25 of the reflector shields are overlapping. To achieve this configuration from the spotlight configuration previously described, the second reflector shield 21 is disengaged from the main reflector 16 by unhooking tabs 66, 68 and 70 from openings 72, 78 and 76, respectively. Tabs 66, 68 and 70 are then inserted in openings 74, 72 and 78, respectively. Openings 72 and 74 are both shared by tabs from both shields, such that sections of the main body portions of the shields between openings 72 and 74 are overlapping, thereby leaving light emitted by the lamp sides in the area between openings 76-78 unblocked and the light emitted by the lamp sides in the area between openings 76-74-72-78 blocked. This configuration effectively blocks substantially 270 degrees of the optical sides 15 of the lamp 14.

The reflector shield 20 may be easily disengaged from the main reflector 16 to which it is engaged, thereby providing a simple method for altering the beam configuration of the luminaire. The tabs 24 are unhooked from the main reflector openings 18, and then reinserted in and rehooked to the openings in a new position for creating a different beam configuration.

Still further beam configurations are possible by adjusting the main reflector 16 in conjunction with the reflector shields 20 and 21. The adjustability of the main reflector is more fully described in U.S. patent application Ser. No. 09/502,794. The following paragraph describes some of the other possible beam configurations when using the adjustable main reflector 16 in conjunction with one or two reflector shields.

In one arrangement, the first reflector shield 20 may be attached to the main reflector 16, with that portion of the main reflector in the normal position. The normal position is when the deployment bars 40 are flat and unbent with fasteners 53 tightened sufficiently to have the main reflector 16 contact the deployment bars. The second reflector shield 21 may be attached to the main reflector 16, with that portion of the main reflector in the down position. The down position is when fasteners 53 have been tightened as much as possible, thereby lowering the ends 41 of the deployment bars 40 as far as possible. This arrangement provides 360 degrees of cutt-off around the vertical sides of the lamp, with the spotlight beam covering less area on the side of the luminaire with the main reflector in the down position.

In another arrangement, the first reflector shield 20 may be attached to the main reflector 16, with that portion of the main reflector in the down position. The remaining portion of the main reflector is in the normal position. This arrangement provides substantially 190 degrees cut-off, and less area covered on the side of the luminaire with the main reflector in the down position.

Two shields 20 and 21 can be attached to the main reflector 16 providing 360 degree cut-off. Half of the main reflector can be set in the down position when two shields are attached.

Two shields 20 and 21 can be attached to the main reflector 16 such that a portion of the shields overlap providing substantially 280 degrees of cut-off with the first shield 20 attached to a portion of the main reflector in the down position and with second shield 21 attached to a portion of the main reflector in the down position and to a portion of the main reflector in the normal position. The arrangement emits light from the portion of the main reflector in the normal position.

In yet another arrangement, two shields 20 and 21 are attached to the main reflector 16 such that a portion of the shields overlap providing substantially 280 degrees of cut-off. The first shield 20 is attached to a portion of the main reflector in the normal position. The second shield 21 is attached to a portion of the main reflector in the down position and to a portion of the main reflector in the normal position, thereby emitting light from the portion of the main reflector in the down position.

As used in this application, directions are intended to facilitate the description of the luminaire of the present invention. Such terms are merely illustrative of the luminaire of the present invention and do not limit the invention to any specific orientation.

While advantageous embodiments have been chosen to illustrate the invention, it will be understood by those skilled in the art that various changes and modifications may be made therein without departing from the scope of the invention as defined in the appended claims.

What is claimed is:

1. A luminaire, comprising:

a housing;

a lamp with optical sides mounted in said housing;

a main reflector mounted in said housing about said lamp, said main reflector having a plurality of openings; and a first removable reflector shield having a body portion and a plurality of tabs extending from said body portion, said tabs being releasably engaged in said openings.

2. The luminaire of claim 1, further comprising:

a second removable reflector shield having a body portion and a plurality of tabs extending from said body portion, said tabs are releasably engaged in said openings.

3. The luminaire of claim 1 wherein said first reflector shield has first, second and third tabs, said first and third tabs being substantially L-shaped, said second tab being substantially T-shaped.

4. The luminaire of claim 1 wherein said openings are substantially semi-circular for receiving said plurality of tabs.

5. The luminaire of claim 1 wherein said first reflector shield is made of a flexible material for adapting to a curve defined by said openings.

6. The luminaire of claim 5 wherein said curve is substantially parabolic.

7. The luminaire of claim 1 wherein said first reflector shield covers at least half of said optical sides of said lamp.

8. The luminaire of claim 1 wherein said first reflector shield is made of specular aluminum.

9. The luminaire of claim 1 wherein said first reflector shield and said plurality of tabs are unitarily formed.

10. A luminaire, comprising:

a housing;

a lamp with optical sides mounted in said housing;

a main reflector mounted in said housing about said lamp, said main reflector having four openings, said openings being substantially semi-circular and located 90 degrees apart;

a first removable reflector shield having a body portion and first, second and third tabs extending from said body portion thereof, said first, second and third tabs being releasably engaged in three of said openings, said first and third tabs being substantially L-shaped, said second tab being substantially T-shaped and being spaced between said first and third tabs; and a second removable reflector shield having a body portion and fourth, fifth and sixth tabs extending from said body portion thereof, said fourth, fifth and sixth tabs being releasably engaged in three of said openings, said fourth and sixth tabs being substantially L-shaped, and said fifth tab being substantially T-shaped and being spaced between said fourth and sixth tabs.

11. The luminaire of claim 10 wherein each of said reflector shields is made of a flexible material for adapting to a curve defined by said openings.

12. The luminaire of claim 11 wherein said curve is substantially parabolic.

13. The luminaire of claim 1 wherein each of said reflector shields covers at least half of said optical sides of said lamp.

14. The luminaire of claim 1 wherein each of said reflector shields is made of specular aluminum.

15. The luminaire of claim 1 wherein each of said reflector shields and said tabs thereof are unitarily formed.

16. A method of blocking and redirecting light from a luminaire, comprising the steps of:

bending a first reflector shield to a shape defined by a plurality of openings in a luminaire reflector mounted in a luminaire; and releasably attaching said first shield to the luminaire reflector by inserting a plurality of tabs on the first shield in the plurality of openings in the luminaire reflector for blocking and redirecting light emitted by a lamp mounted in the luminaire, the lamp having optical sides, and said first shield covering substantially half of the optical sides of the lamp;

whereby a first beam configuration is created.

17. The method of claim 16, further comprising the steps of:

bending a second reflector shield to the shape defined by the plurality of openings in the luminaire reflector mounted in the luminaire; and releasably attaching said second shield to the luminaire reflector by inserting a plurality of tabs on said second shield in the plurality of openings in the luminaire reflector for further blocking and redirecting light emitted by the lamp mounted in the luminaire, said second shield covering substantially half of the optical sides of the lamp;

whereby a second beam configuration is created.

18. The method of claim 17 wherein said first and second reflector shields are attached on opposite sides of the reflector for completely enclosing the optical sides of the lamp, thereby cutting off 360 degrees of light emitted by the lamp and resulting in a spotlight beam being emitted from the luminaire.

19. The method of claim 17 wherein said first and second reflector shields are attached on the luminaire reflector such that substantially 90 degrees of said first and second shields overlap, thereby cutting off substantially 270 degrees of light emitted by the lamp.

20. The method of claim 17, further comprising:

removing said second reflector shield; and reattaching said second shield to the luminaire reflector in a different position by inserting said plurality of tabs on said second shield in the plurality of openings in the luminaire reflector for altering the second beam configuration.

* * * * *